United States Patent [19]

Reed

[11] Patent Number: 4,802,315

[45] Date of Patent: Feb. 7, 1989

[54] BUILDING CONSTRUCTION

[76] Inventor: William Reed, P.O. Box 1267, Marathon, Fla. 33050

[21] Appl. No.: 58,951

[22] Filed: Jun. 5, 1987

[51] Int. Cl.[4] ..... E04H 1/00

[52] U.S. Cl. ..... 52/79.4; 52/643; 52/236.1

[58] Field of Search ..... 52/643, 93, 79.4, 79.1, 52/236.1

[56] References Cited

U.S. PATENT DOCUMENTS

| | | | |
|---|---|---|---|
| 2,792,125 | 5/1957 | Gallacher | 52/236.1 X |
| 3,044,919 | 7/1962 | Stoneburner | 52/DIG. 7 X |
| 3,156,018 | 11/1964 | Slayter | 52/643 X |
| 3,279,132 | 10/1966 | Slayter | 52/643 X |
| 3,571,993 | 3/1971 | Potter | 52/93 X |
| 3,662,502 | 5/1972 | Wright | 52/93 |
| 4,115,962 | 9/1978 | Caisley | 52/79.4 |
| 4,514,938 | 5/1985 | Maguire | 52/236.1 X |

FOREIGN PATENT DOCUMENTS

| | | | |
|---|---|---|---|
| 1550438 | 12/1968 | France | 52/93 |

*Primary Examiner*—Carl D. Friedman

*Attorney, Agent, or Firm*—John Cyril Malloy

[57] ABSTRACT

The present invention relates to a system of building construction as well as the specific components of the building itself wherein a plurality of continuously configured truss-like primary framers are arranged in spaced apart parallel relation to one another and wherein each comprises a roof section, a floor section and oppositely disposed wall sections. The corresponding sections of each primary framer collectively define the roof, floor and wall portions of the resulting building and further wherein secondary framers of somewhat similar structural configuration form the end portions of the building. A characterizing feature of the resulting building is at least one longitudinal side wall having outward extending angularly oriented first and second wall portions which deviate from the conventional vertically oriented external bearing walls found in conventional building construction.

7 Claims, 4 Drawing Sheets

BUILDING CONSTRUCTION

BACKGROUND OF THE INVENTION

1. Field of the Invention

Conventional components, methods and overall systems used in building construction whether the resulting building is used for domestic, commercial or recreational, purposes, requires generally skilled labor. Such construction techniques are extremely time consuming and utilizes a variety of relatively "expensive" materials all of which add not only to the cost of initial construction and maintenance but add to the time for construction. The prior art is replete with building components, short step methods, techniques and the like, attempting to reduce the cost and time of construction in an effort to allow for a wider variety of structures at a more reasonable cost. While certain building components, materials and techniques have in fact accomplished their intended purposes, many include what is considered a certain inherent disadvantage depending upon the particular design or characteristic that is desired in a given building structure.

Even with the existing attempted solutions of the above noted problem there is still a need in the building industry for a system incorporating structural components in buildings which add not only to the versatility and design but allow for an inexpensive, time saving system of building construction with the resultant building being strong, aesthetically pleasing and comparatively maintenance free relative to domestic, commercial or recreational buildings using conventional or prior art systems of construction.

SUMMARY OF THE INVENTION

The present invention is directed towards a system of building construction using common material components in the formation of the building under construction as well as an exterior coating comprised of an elastomeric base, textured "membrane" with a weather resistant finish.

The framing of a building being constructed and utilizing the system or techniques of the subject invention comprises a plurality of primary framer structures. The framers are preferably constructed from GNI wood beams manufactured by Gang Nail Systems, Inc. (or an acceptable alternative). The primary framers are collectively disposed and configured to at least partially form both the upper and lower portion of the building and are generally configured into a continuous truss-like structure. The roof portion, floor portion and longitudinal side wall portions of the building are each defined by the plurality of primary framers with the addition of internal and external facing means supplied thereto so as to define the floors, ceilings, and interior and exterior wall surfaces. Depending on the size and overall intended configuration of the building additional vertical supports may be utilized in combination with one or a plurality of the primary framers.

Secondary framers are located at the ends of the building under construction and define the end wall portions of such building. They are connected in a substantially transverse or in some cases perpendicular relation to the end most primary framers by being attached thereto.

The angles of the primary and secondary framers are connected with plywood gussets located at the upper, middle and lower portions for the primary and secondary framers wherein each gusset is cut to form a specific angle required by the overall design. Such gussets are glued and/or screwed together on opposites sides of the beam structure defining the primary or secondary framers in substantially flush or overlying relation with the outer most surface of the beam and have a width that does not exceed the overall width of the beam itself.

Depending on the overall design both door and window openings are included in the building under construction. Entrance into the subject building is through an entrance formed by a floor level entrance header wherein the width or transverse dimension of the opening is determined by the location where it is placed in the longitudinal side wall (or end wall portion) of the building under construction. The header assembly is constructed preferably and installed prior to any primary or secondary cutting and the opening height is determined by the rough end dimension required for that particular requirement. It is constructed using standard framing methods with the header constructed from Gang-Lam LVL, manufactured by Gang Nail Systems, Inc. or its reasonable alternative. The insulation of the floor level entrance header automatically forms a natural soffit and overhang.

Exterior corners can be treated in several methods which include total enclosure providing for complete corner framing with no allowance for glass or external openings. A second alternative is a prefabricated metal framed atrium corner section allowing maximum use of glass in either the upper or lower corresponding wall portions of the building depending on preference in design, appearance, etc. Other alternatives for corner section treatment are of course applicable without departing from the scope of the present invention.

Windows are preferably, according to a preferred design of the subject building structure, of the VELUX type—sold by Velux-America, Inc. or any acceptable alternative, positioned between adjacently disposed primary or secondary framers. Standard application of the floor level entrance header may provide special window designs in each building being constructed.

Various foundation attachments, both crawl and full foundations, are allowed to be within the scope of the present invention. The foundations attached to the primary framer, being either column or pier attachments, require the lower portion of the building to be completely enclosed. The lower portion is then completely sheathed in plywood (or applicable material) and finished to match the exterior as intended and designed.

The exterior surface comprises a high grade plywood substrate which is covered by an elastomeric membrane using preferably a two-part system with an alternate, intermediate coating which allows for a plaster type finish. The first coat applied includes an elastomeric membrane material combined with a fiber mesh reinforcement. An alternate, intermediate coating includes the same elastomeric membrane material mixed with high grade, sprayable silica sand. Such intermediate coating is then sprayed onto the exposed surface, set, pulled and troweled to the desired exterior finish. The final coating is a smooth elastomeric finish which finalizes the outer coatings of the overall design.

Interior facing may include conventional furring strips which run perpendicular to the primary framers. Final finish or drywall, etc., may then be used as a completed interior wall finish. Also, substantially conventional floor and ceiling finishes may also be applied in a similar manner or in a conventional manner considering the existence of the primary and secondary framers defining the framing and support of the resulting building structure.

The invention accordingly comprises features of construction, a combination of elements, and an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like reference parts throughout the several views of the drawings.

DETAILED DESCRIPTION OF THE PREFERRED EMBODIMENT

Figure 1:
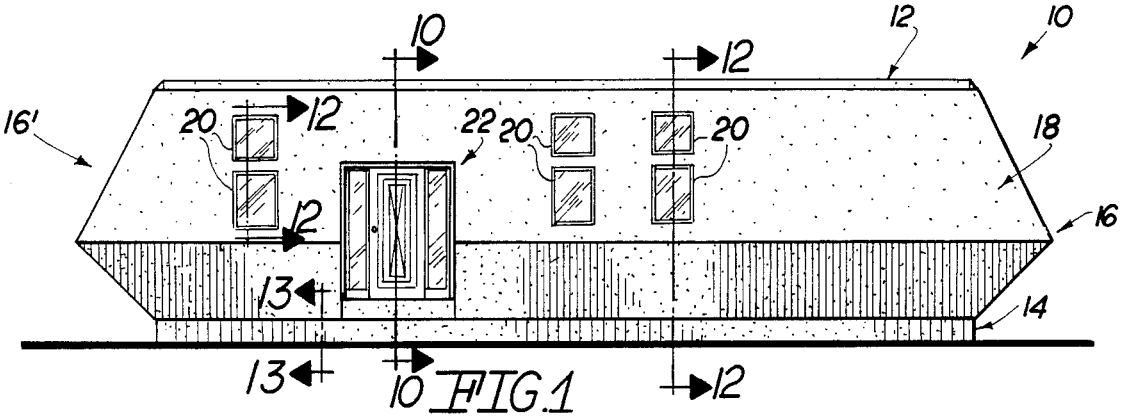
FIG. 1 is a longitudinal side plan view of a preferred embodiment of the building under construction incorporating the construction system of the present invention.
Figure 2:
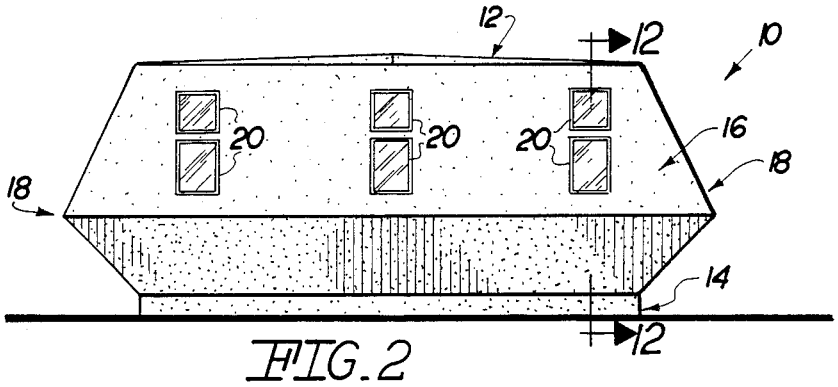
FIG. 2 is an end plan view of the embodiment in FIG. 1.
Figure 3:
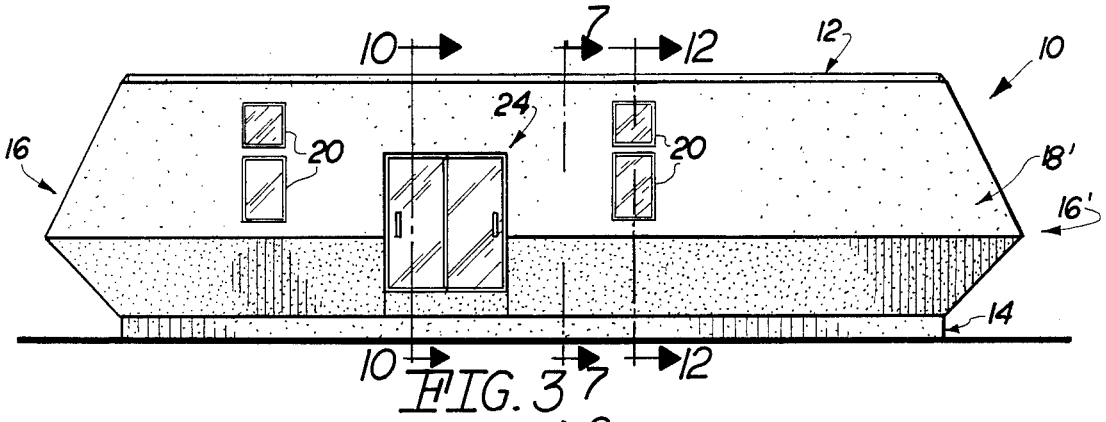
FIG. 3 is a rear plan view of the embodiment in FIGS. 1 and 2.

The present invention is directed to a construction system and also to the implementation of a plurality of structural components in the formation of a building where the building may be used for domestic, recreational or commercial purposes. As shown in FIGS. 1 through 4, the building is generally designated as 10 and comprises what may be generally considered a roof portion 12, floor or foundation portion 14, oppositely disposed end wall portions, generally indicated as 16 and longitudinal side wall portions generally indicated as 18. FIGS. 1 and 3 show opposite longitudinal side portions 18 and 18' and FIGS. 2 and 4 similarly show opposite end wall portions 16 and 16' respectively.

An obviously distinguishing feature of the appearance of the subject building structure 10 is, in the preferred embodiment as shown in FIGS. 1 through 4, the outward angular extension of both the side wall portions 18 and 18' and the end wall portions 16 and 16' wherein such wall portions deviate or extend angularly outward from what may be considered a normal vertical orientation of external bearing walls. This specific outwardly angled orientation or configuration adds not only to the aesthetic appearance of the building 10 but provides improved structural characteristics. The formation of this specific configuration as shown in FIGS. 1 through 4 will be discussed in greater detail while more fully explaining, hereinafter, the structural components used in the formation of the building 10.

Figure 4:
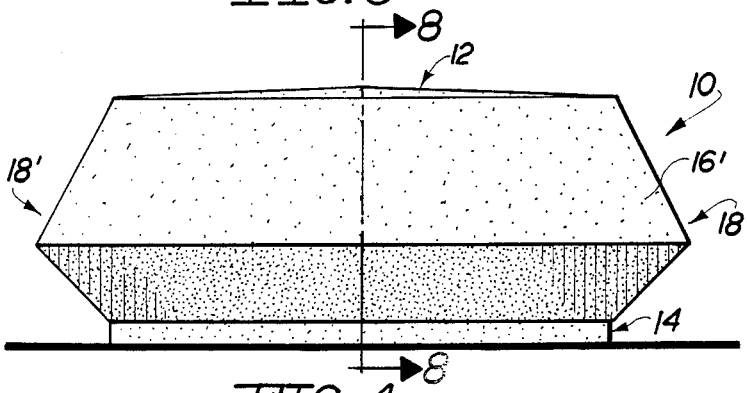
FIG. 4 is an opposite end view relative to that of FIG. 2 of the preferred embodiment of FIGS. 1, 2 and 3.

Other structural details of the building assembly 10 are also shown in FIGS. 1 and 4 and comprise a plurality of windows 20 formed and placed in accordance with the intended and preferred design of the building assembly 10 and of course which may be varied dependent upon the original design of the architect, builder and/or purchaser. Similarly, door structures including a front door assembly, at ground level and generally being indicated as 22, is formed in what may be considered a front longitudinal side 18 of the building structure 10. Similarly, a rear door assembly 24 may be formed in what may be considered a rear longitudinal side 18' of the building structure 10 and is pictured accordingly.

Figure 5:
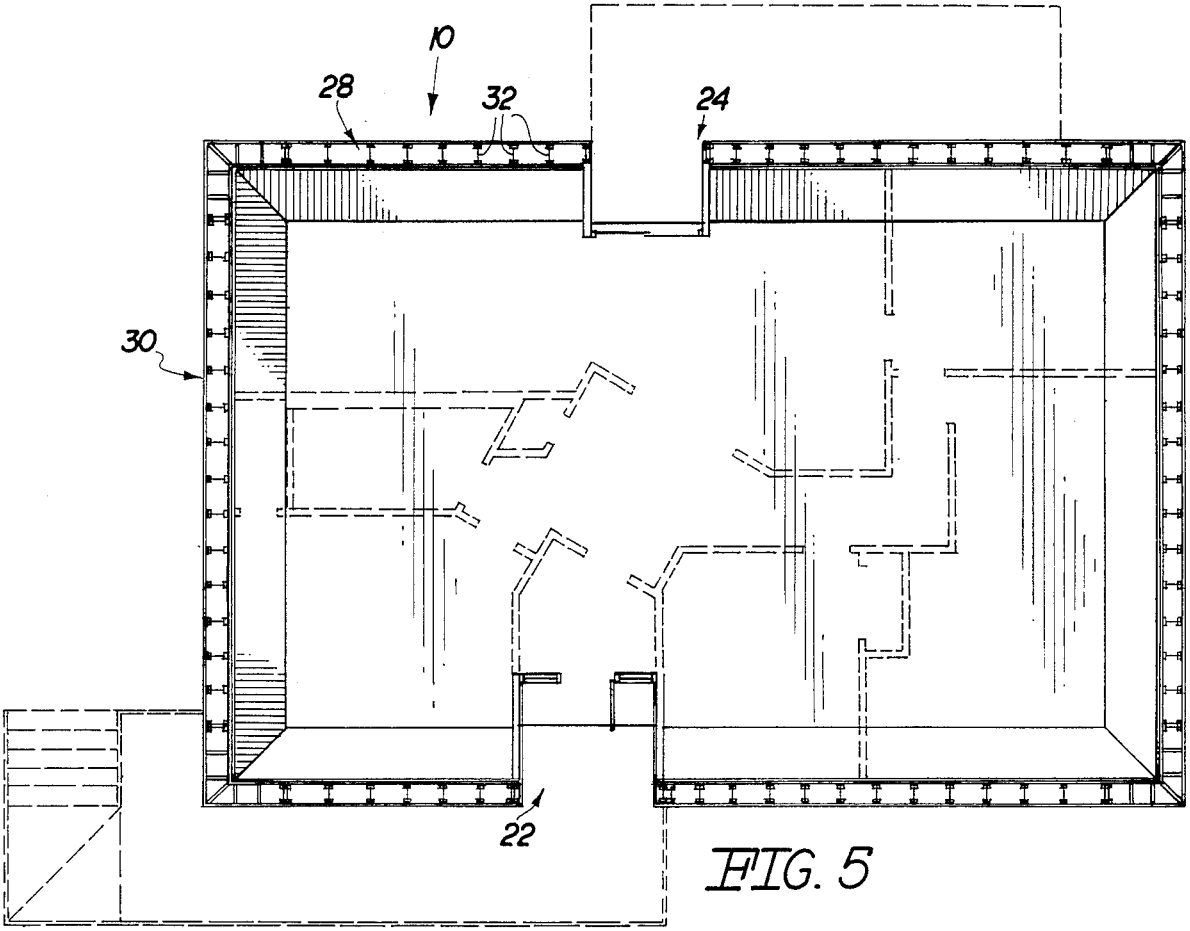
FIG. 5 is a longitudinal sectional view represented in solid lines and incorporating a proposed floor plan, both exterior and interior, represented in phantom lines.
Figure 6:
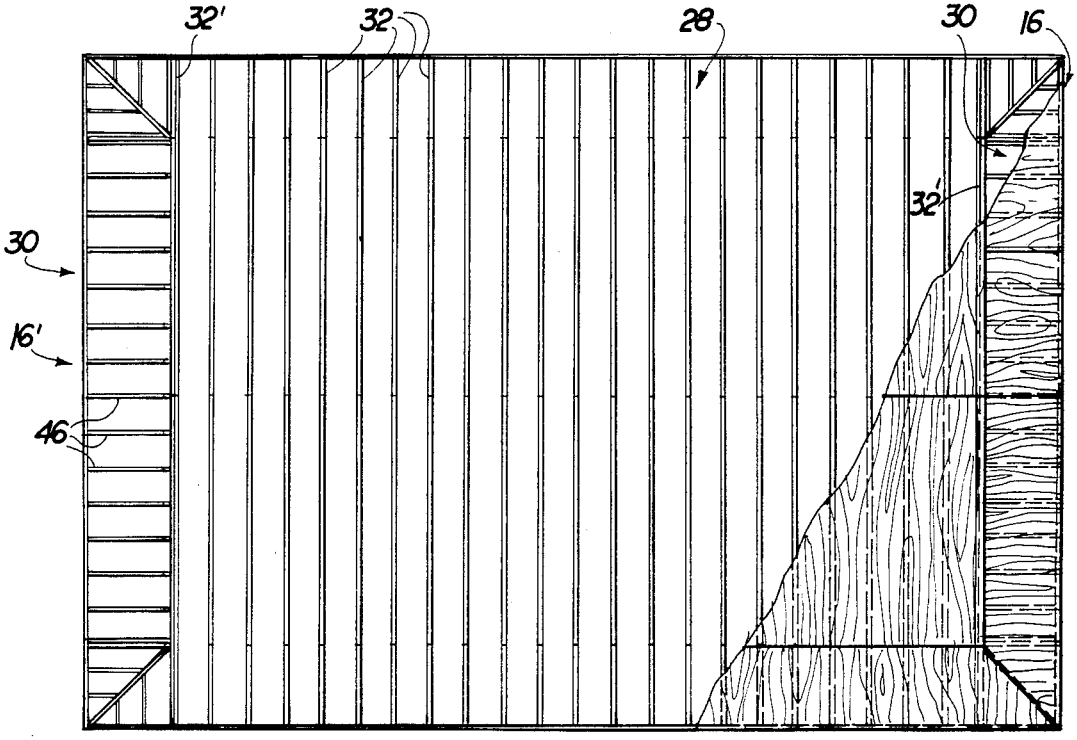
FIG. 6 is a top plan view in partial cut-away showing details of both the roof and the framing portions of the subject building under construction.

With reference primarily to FIGS. 5 through 9 the construction system of the present invention comprises a primary framing means generally indicated in FIG. 6 as 28 and a secondary framing means generally indicated as 30. The primary framing means 28 comprises a plurality of spaced apart substantially parallel primary framers 32 shown in detail in FIGS. 7 through 9 and disposed and structured into a substantially truss-like configuration (see FIG. 7). The primary framers each include a continuous and closed configuration including a roof section 34, a floor section 36, an oppositely disposed wall sections 38 and 40. Each of the sections 34, 36, 38, and 40 are secured together at correspondingly positioned and mating ends by gussets 42 configured into an angular configuration which corresponds to the junctions of the ends being connected and which may be glued, screwed or otherwise affixed in the locations indicated. The various sections of each truss-like framer 32 is formed from a GNI beam or beam segment shown in cross-section in FIG. 9 and also represented as 32. A fill or supplementary beam section 45 may be added to an upper portion of the roof section 34 in order to provide the proper slant or angle on the roof portion 12 of the building. It should be noted from a review of FIG. 6 that the parallel spaced apart orientation of the primary framers 32 is such as to collectively define the roof portion 12, opposite longitudinal end portions 18 and floor portion 14 by the corresponding and collective disposition of the roof sections 34, wall sections 38 and floor sections 36 respectively of each truss-like primary framer 32.

It should further be noted that at the opposite end location of the primary framing means 28 there is located two primary framers in cooperative, immediately adjacent and side by side relation as at 32'. These end most primary framers 32' serve as support and connection for the secondary framing means 30 which comprises a plurality of spaced apart side by side oriented and interconnected secondary framers 46 which define the end walls 16 and 16'. The secondary framers 46 have their opposite ends secured to the end most primary framers as at 32' and extend angularly outward into a V-shaped cross-sectional configuration to form the angularly outward extending end wall as shown in FIGS. 1 through 4.

Similarly, each of the truss-like primary framers 32 include the end sections 38 and 40 being defined by a first wall segment 43 and a second wall segment 47 also extending angularly outward into a substantially V-shaped cross-sectional configuration and thereby deviating from what may normally be considered a conventional vertically oriented external bearing wall. This configuration also provides the outwardly extending V-shaped longitudinal side wall configurations as pictured in FIGS. 1 through 4.

Figure 7:
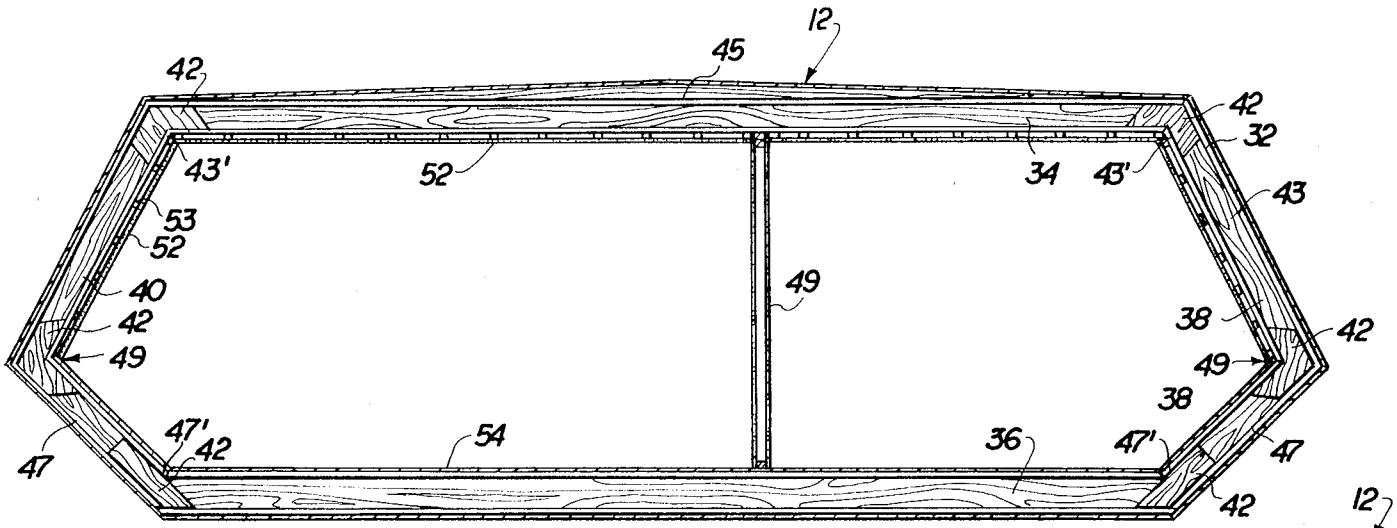
FIG. 7 is a transverse sectional view along line 7—7 of FIG. 3 showing details of a primary framer structure of the present invention.
Figure 9:
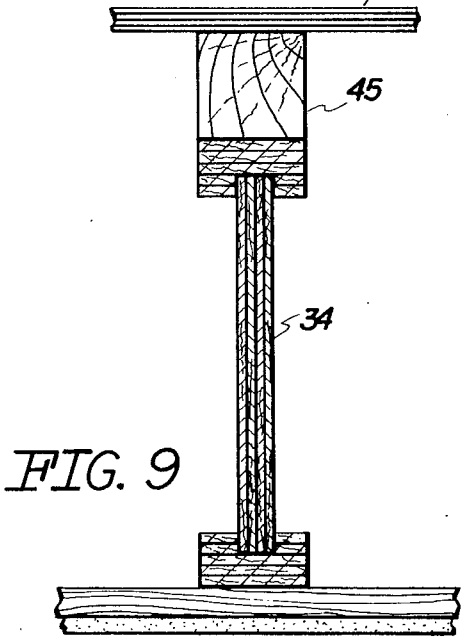
FIG. 9 is a sectional view in partial cut-away along line 9—9 of FIG. 8.
Figure 8:
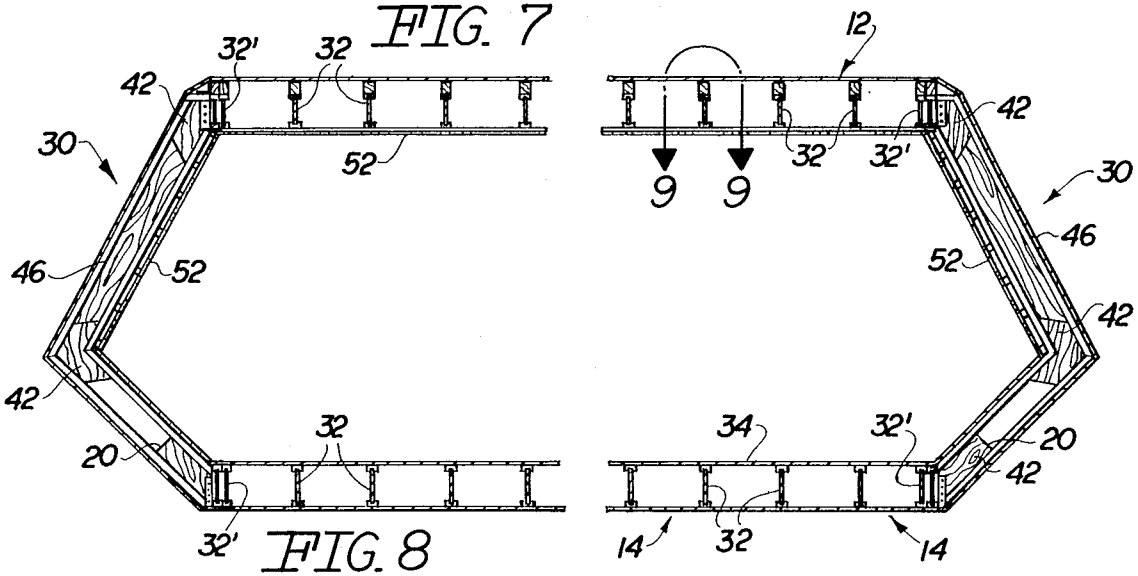
FIG. 8 is a longitudinal sectional view along line 8—8 of FIG. 4 showing details of both the primary and secondary framer structures of the present invention.

As also pictured in FIG. 7, depending upon the size and expanse of the truss-like primary framers 32 one or more supplementary vertical supports as at 49 may be positioned on the interior thereof between the roof sections 34 and the floor sections 36 of each primary framer 32.

Again with reference primarily to FIG. 7 the first and second wall segments 43 and 47 of each wall section 38 and 40 has its opposite supposedly free end as at 43' and 47' respectively secured to the oppositely positioned roof sections 34 and floor sections 36 respectively. The first and second wall segments 43 and 47 are joined to one another at what may be considered a common junction generally indicated as 49. As set forth above, both the primary framers and secondary framers are formed from a truss-like construction defined by a GNI beam or beam assembly of the type shown in the figures herein. Accordingly, both the longitudinal side walls and the end walls are defined as load-bearing walls due to the particular construction of the primary and secondary framers as set forth above.

FIG. 5 shows in phantom lines what may be a typical floor plan on the interior of the building assembly 10 and also shows the location of foundation portion leading to and from the front and rear door assemblies 22 and 24.

Internal facing means may be in the form of dry wall structure 52 and furring strips 53 may be attached to the appropriately positioned portions of the primary and secondary framers in order to provide, in a some what conventional fashion ceiling, end or wall surfaces as indicated. Also, the internal facing means may include specific flooring structure as at 54 secured in a conventional manner.

Figure 15:
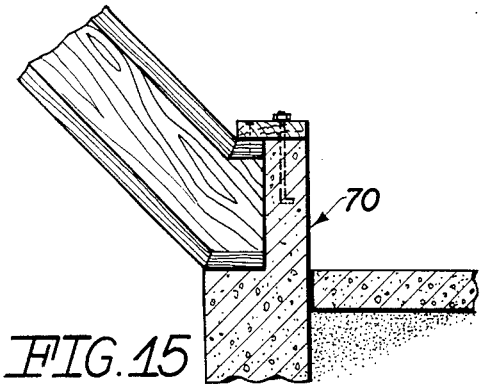
FIG. 15 is a detailed sectional view similar to that of FIGS. 13 and 14.
Figure 16:
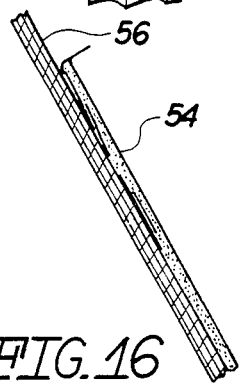
FIG. 16 is a sectional view in partial cut-away showing an external membrane affixed to the outer surface of the building under construction.

External facing means (see FIGS. 1 through 4 and 16) may include a plywood or like material substrate 56 and an elastomeric sealed membrane 58 continuously formed on the exterior surface of the plywood substrate 56 as shown in FIG. 16. The exterior surface membrane, as set forth in FIGS. 15 and 16 and shown exteriorly in FIGS. 1 through 4, comprises the high grade exterior plywood substrate 56 being $\frac{5}{8}$ to $\frac{3}{4}$ inches wherein the exterior surface thereof is covered by the elastomeric membrane 54. Preferably, the formation and application of the elastomeric membrane is a two part system with an alternate, intermediate coat which allows for a plaster-look type finish. The first coat applied includes an elastomeric membrane material in uncured state combined with a fiber mesh reinforcement being commercially available. The alternate coating comprises the same elastomeric membrane in uncured state with a high grade, sprayable silica sand. This is then sprayed onto the exterior surface, set, pulled and troweled into the desired finish or texture. The final coat is a similar elastomeric material of smooth grade finish which finalizes the outer coatings of the design.

Figure 10:
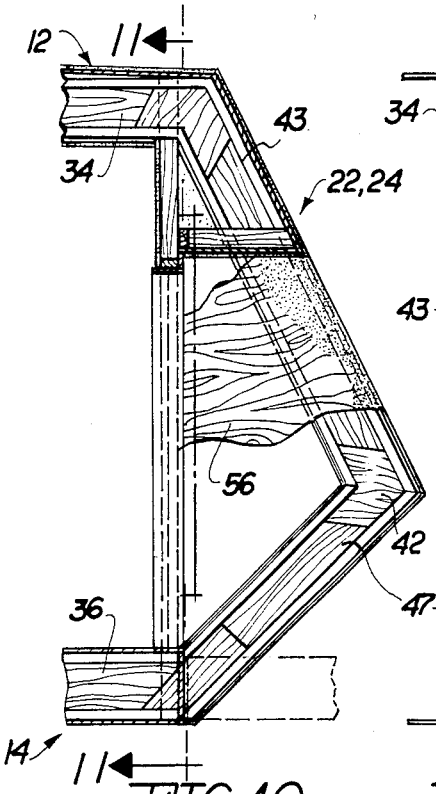
FIG. 10 is a sectional view along line 10—10 of FIG. 1.
Figure 11:
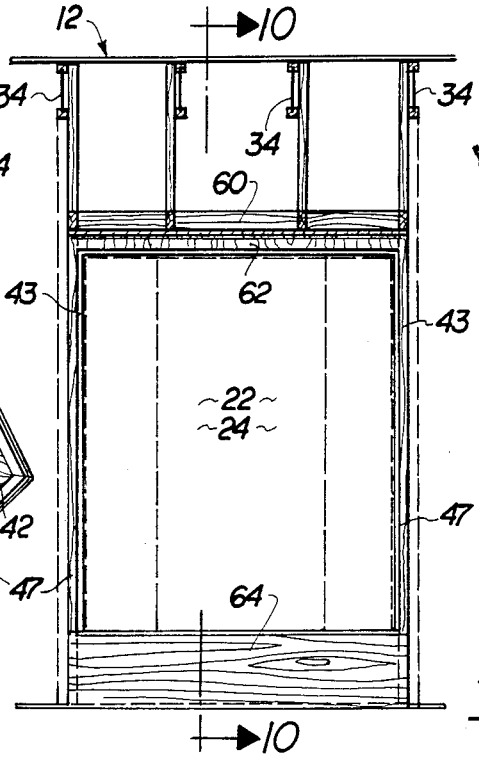
FIG. 11 is a sectional view along line 11—11 of FIG. 10.
Figure 12:
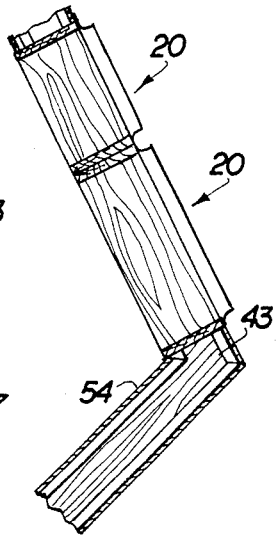
FIG. 12 is a transverse sectional view in partial cut-away along line 12—12 of FIG. 1.

FIGS. 10 and 11 relate to the formation of the header structure for both the front and rear door assemblies 22 and 24 and include, in addition to the components already set forth, and indicated by appropriate reference numerals in FIGS. 10 and 11, brace beams. The brace beams are located above and below the door assembly and include, in cooperation with the disposition of the primary framers, a natural overhang and soffit as set forth above. Such interconnecting brace members 60, 62 and 64 are provided in the space normally occupied by cutaway segments of the wall segments 43 and 47 of adjacently positioned primary framers 32. FIG. 12 discloses window structures located between the spacing of the primary (and secondary) framers showing their orientation in conformance with the segments 43 of the primary framers.

Figure 13:
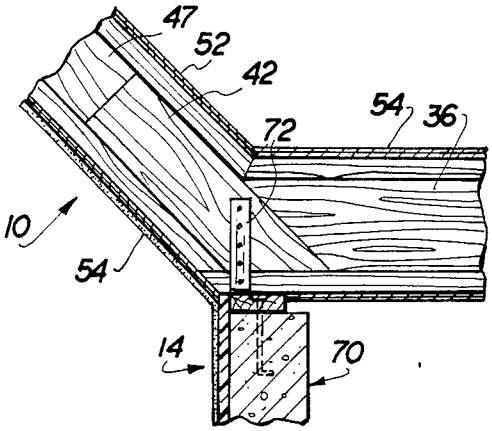
FIG. 13 is a sectional view in partial cut-away along line 13—13 of FIG. 1.
Figure 14:
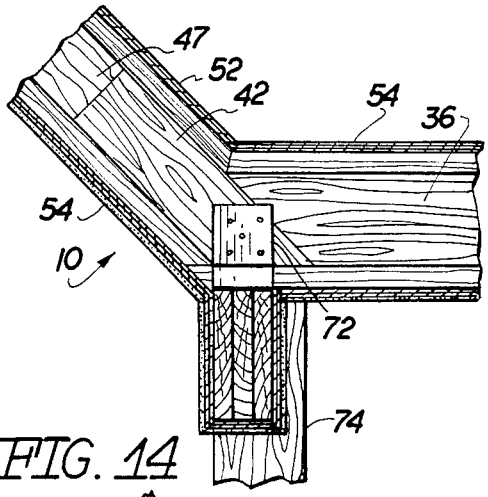
FIG. 14 is a detailed sectional view similar to that of FIG. 13.

FIGS. 13, 14 and 15 show additional flooring and/or foundation structures wherein the foundation is shown in concrete pilings, pourings, etc., and generally indicated as 70. FIG. 14 is of a foundation on the stilts or lifts spaced wherein the entire building structure 10 is spaced above the ground a considerable distance. Conventional hardware as at 72 is provided for interconnection.

Now that the invention has been described,

What is claimed is:

1. A building system for the construction of a building usable for domestic, commercial and/or recreational purposes, said system comprising:

(a) a primary framing means for support of and at least partially defining the roof portion, side wall portions and floor portion of the building, and a secondary framing means secured to said primary framing means and disposed for formation of oppositely disposed, load-bearing end wall portions of the building, (b) a foundation assembly disposed in supporting relation to said primary and secondary framing means and mounted on a support surface on which the building is constructed, (c) said primary framing means comprising a plurality of primary framers disposed in spaced, parallel relation to one another and collectively extending along a length of the building, (d) at least a majority of said plurality of primary framers each comprising a substantially continuous configuration including a roof section, a floor section and two side wall sections, (e) said side wall sections of said primary framers collectively defining load-bearing longitudinal side walls of the building and each side wall section thereof comprising a first and a second wall segment interconnected at correspondingly positioned ends at a first junction, said first wall segments of said primary framers extending angularly outward from said roof section to said first junction and collectively defining an outwardly extending angularly oriented first side wall portion of said building, said second wall segments of said primary framers extending angularly outward from said floor section to said first junction and collectively defining an outwardly extending, angularly oriented second side wall portion of the building, (f) said plurality of secondary framers collectively extending along both ends of the building in spaced, parallel relation to one another and in transverse relation to one of two endmost primary framers; said plurality of secondary framers extending from said roof section to said floor section of correspondingly positioned endmost ones of said primary framers, each secondary framer comprising a first and a second side wall segment interconnected at a corresponding end at a second junction, (g) said first end wall segment extending angularly outward from said roof section to said second junction and collectively defining an outwardly extending angularly oriented first end wall portion of said building, said second end wall segments extending angularly outward from said floor section to said second junction and collectively defining an outwardly extending angularly oriented second end wall portion of the building, (h) internal facing means for forming internal, exposed surfaces of the building being mounted on interior portions of said plurality of primary and secondary framers, (i) external facing means for forming external portions of the building being mounted on exterior portions of said plurality of primary and secondary framers, and (j) each of said side wall portions and said end wall portions of the building extending outwardly from a substantially vertical orientation into a substantially V-shaped configuration along their respective lengths.

2. A system as in claim 1 wherein said first and said second junctions of said primary and secondary framers respectively, collectively define straightline configurations along side wall and end wall portions of the building respectively, said first and second junctions being substantially coplanar to one another.

3. A system as in claim 1 wherein said side wall portions and said end wall portions are further defined by inner and outer wall surface portions each extending outwardly from a substantially vertical orientation and into a substantially V-shaped configuration along respective lengths thereof.

4. A system as in claim 1 wherein said external facing means comprises a substrate secured at least to the outer surface portions of said side and end wall sections of said plurality of primary and secondary framers and an elastomeric membrane secured and covering outer surface portions of said substrate.

5. A system as in claim 4 wherein said elastomeric membrane comprise a first coating of elastomeric material combined with a fiber mesh material.

6. A system as in claim 5 wherein said elastomeric membrane further comprises an intermediate elastomeric material coating combined with a silica sand having a consistency capable of being sprayed onto an exposed surface of said first coating and set and troweled to a desired finished.

7. A system as in claim 6 wherein said elastomeric membrane further comprises a final coating applied to an exposed surface of said intermediate coating and comprising a smooth grade elastomeric finish.

* * * * *